US007212762B2

(12) United States Patent
Watabe

(10) Patent No.: US 7,212,762 B2
(45) Date of Patent: May 1, 2007

(54) IMAGE PROCESSING APPARATUS WITH PREHEATING CONTROL

(75) Inventor: Tomonori Watabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 48 days.

(21) Appl. No.: 11/041,286

(22) Filed: Jan. 25, 2005

(65) Prior Publication Data

US 2005/0163525 A1 Jul. 28, 2005

(30) Foreign Application Priority Data

Jan. 27, 2004 (JP) ..... 2004-018585

(51) Int. Cl.
*G03G 15/20* (2006.01)

(52) U.S. Cl. ..... 399/70

(58) Field of Classification Search ..... None
See application file for complete search history.

(56) References Cited

U.S. PATENT DOCUMENTS 6,353,719 B1 * 3/2002 Lee ..... 399/69
2004/0190924 A1 * 9/2004 Iwasaki et al. ..... 399/68
2005/0169654 A1 * 8/2005 Asayama ..... 399/67

FOREIGN PATENT DOCUMENTS

JP 07064433 A * 3/1995
JP 07-248701 9/1995

* cited by examiner

*Primary Examiner*—Quana Grainger
(74) *Attorney, Agent, or Firm*—Rabin & Berdo, PC

(57) ABSTRACT

An image forming apparatus has a fuser that fuses a toner image onto a printing medium by heat and pressure. The fuser temperature is sensed, and a heater in the fuser is controlled to keep the fuser at a constant temperature appropriate for fusing. In addition to constant-temperature control, the fuser is preheated to prevent an anticipated drop in its temperature when the printing medium encounters the fuser. The preheating process is carried out selectively and is omitted when not required, as determined from, for example, the temperature of the fuser when the printing medium enters the image forming unit of the image forming apparatus, the interval between the transport of different sheets of the printing medium, or the average amount of heat generated by the heater during a preceding interval.

24 Claims, 11 Drawing Sheets

IMAGE PROCESSING APPARATUS WITH PREHEATING CONTROL

BACKGROUND OF THE INVENTION

1. Field of the Invention

The present invention relates to an image forming apparatus having a fuser that thermally fuses a recording agent onto printing media, more particularly to the temperature control of the fuser.

2. Description of the Related Art

Japanese Unexamined Patent Application Publication No. H7-248701 describes a method of controlling the temperature of this type of fuser by using a temperature sensor to sense the temperature of the fuser and a comparator to compare the sensed temperature with a threshold. A heater in the fuser is turned on and off according to the comparison result, using different turn-on and turn-off thresholds.

When this method is practiced, the temperature sensor generally senses the surface temperature of a fusing roller. This temperature tends to drop when the surface of the printing medium makes contact with the fusing roller. Although the temperature sensor may detect the drop and turn on the heater, it takes time for heat to reach the surface from the heater, which is located at the center of the fusing roller. The low temperature is therefore not corrected immediately, causing a so-called cold offset that can produce gloss irregularities and possible inadequate fusing.

This problem is aggravated by the relatively low fusing temperatures that are now used to reduce power consumption and increase printing speed in much image forming apparatus. To obtain adequate heating of printing media at these low fusing temperatures, the area of contact between the fusing rollers and the printing medium must be increased. The diameter of the fusing roller or the thickness of the layer of rubber on its surface has therefore been increased, so that it takes even longer for heat to reach the surface from the heater, lengthening the duration of the cold offset.

The cold offset could be mitigated by temporarily raising the turn-on threshold before each sheet of printing media entered the fuser, but this scheme would invite the opposite problem: a hot offset could occur.

SUMMARY OF THE INVENTION

An object of the present invention is to provide an image forming apparatus with a fuser that can maintain a stable fusing temperature throughout the fusing process, including the initial part of the fusing process.

The invented image forming apparatus has an image forming unit and a fuser. A toner image is formed on a printing medium as the printing medium is transported through the image forming unit, then fused onto the printing medium by heat and pressure as the printing medium passes through the fuser. The fuser is heated by a heater. A temperature sensor senses the temperature of the fuser. A control unit controls the heater according to the temperature sensed by the temperature sensor to hold the fuser at a predetermined target temperature during the fusing process. The control unit also has the heater preheat the fuser before the fusing process to prevent an anticipated drop in the temperature of the fuser when the printing medium encounters the fuser. The preheating process is carried out selectively according to, for example, the temperature of the fuser sensed as the printing medium enters the image forming unit, the interval between the transport of different sheets of the printing medium, or the average amount of heat generated by the heater during an interval preceding the time when the printing medium enters the image forming unit.

The heater may be disposed inside a fusing roller in the fuser. The preheating process provides the fusing roller with a store of internal heat that is conducted to the surface of the roller in time to compensate for the initial loss of heat to the printing medium, thereby anticipating the temperature drop that occurs when the printing medium encounters the fusing roller and giving the constant-temperature control process a compensating head start so that the surface of the fusing roller can be kept at an appropriate temperature throughout the fusing process.

The fuser may have two fusing rollers with respective heaters and temperature sensors, the preheating of each fuser roller being controlled independently.

DETAILED DESCRIPTION OF THE INVENTION

Figure 1:
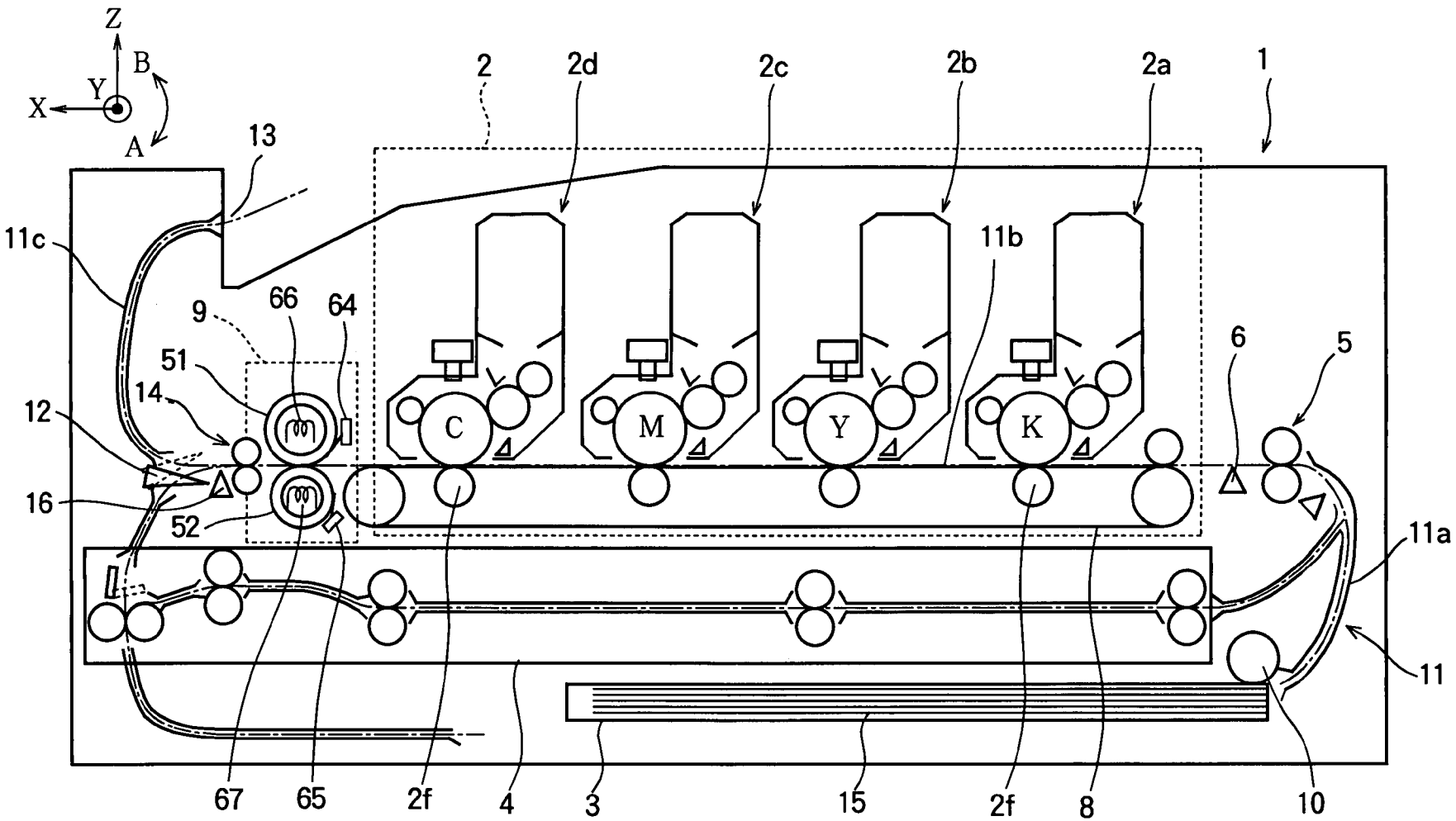
FIG. 1 is a side sectional view of an electrophotographic printer in which the present invention can be employed.

Embodiments of the invention will now be described with reference to the attached drawings, in which like elements are indicated by like reference characters.

First Embodiment

Referring to FIG. 1, the image processing apparatus 1 in the first embodiment is a two-sided color printer with a printing process unit 2 having black (K), yellow (Y), magenta (M), and cyan (C) developing units 2*a*, 2*b*, 2*c*, 2*d* and corresponding transfer rollers 2*f*. Printing media can be fed into the printing process unit 2 from either a cassette 3 or a double-sided paper feeding unit 4. Before entering the printing process unit 2, the printing media are aligned by a registration roller 5 and detected by a printing media sensor 6. Within the printing process unit 2, the printing media are transported by a transport belt 8, which carries the printing media between a photosensitive drum in each developing unit 2*a*, 2*b*, 2*c*, 2*d* and the corresponding transfer roller 2*f*. The printing process unit 2 functions as the image forming unit by forming black, yellow, magenta, and cyan toner images on the photosensitive drums in the developing units 2*a*, 2*b*, 2*c*, 2*d* and transferring the toner images to the printing media as the printing media travel through the printing process unit 2. After leaving the printing process unit 2, the printing media pass through a fuser 9 in which the toner images are fused onto the printing media.

In the following description, the printing media will be assumed to be sheets of printing paper 15 stored in the cassette 3. The sheets of printing paper 15 are picked up one by one by a hopping roller 10 and fed into the first part 11*a* of the transport path 11, which takes them to the registration roller 5. After the leading edge of the printing paper 15 has been aligned against the registration roller 5 to correct transport skew, the registration roller begins to turn, sending the printing paper 15 onto the transport belt 8, to which the printing paper is attracted by electrostatic force. Upon leaving the fuser 9, if printing has been completed, the printing paper 15 is directed by a path selection guide 12 to a third part 11*c* of the transport path 11, which takes the printing paper through a delivery unit 13 and delivers the printed pages into a delivery tray at the top of the image forming apparatus 1. In this part 11*c* of the transport path, the printing paper 15 is driven by a delivery roller 14, and is detected by a delivery sensor 16. In double-sided printing, after an image has been fused onto one side of the printing paper 15, the path selection guide 12 sends the printing paper 15 to the double-sided paper feeding unit 4, which turns the printing paper over, then returns the printing paper to the first part 11*a* of the transport path so that another image can be formed on the other side.

The transport mechanism that transports the printing media thus includes the registration roller 5, transport belt 8, hopping roller 10, and delivery roller 14. The path selection guide 12 is normally set in the position indicated by the solid lines, but is moved to the position indicated by the dashed lines to guide the printing paper 15 into the double-sided paper feeding unit 4 for double-sided printing. In the XYZ coordinate system shown in the drawing, the positive X axis indicates the direction in which the printing paper 15 travels through the printing process unit 2, the Y axis is parallel to the axes of rotation of the transfer rollers 2*f*, and the Z axis is orthogonal to the X and Y axes.

The printing media sensor 6 is, for example, a photoelectric sensor disposed near the transport path 11 between the registration roller 5 and the printing process unit 1. The printing media sensor 6 outputs a media detection signal at, for example, the high logic level (H) while printing paper 15 is traveling past the printing media sensor 6 and at the low logic level (L) at other times, i.e. when no printing paper 15 is present facing the printing media sensor 6. Similarly, the delivery sensor 16 outputs a media exit signal that is high (H), for example, when the printing paper 15 is traveling past the delivery sensor 16 and low (L) at other times.

The fuser 9 includes an upper fusing roller 51 and a lower fusing roller 52, the axes of rotation of which are parallel to the Y axis in the coordinate system shown in the drawing. The upper fusing roller 51 turns in direction A; the lower fusing roller 52 turns in direction B. The upper fusing roller 51 is driven by a motor; the lower fuser roller is urged by springs (not shown) against the upper fusing roller 51 and turns in compliance with the upper fusing roller 51.

The surface temperatures of the fusing rollers 51, 52 are detected by respective fusing roller temperature sensors 64, 65 of the contact type, comprising thermistors. Each temperature sensor includes a plate spring that presses the thermistor end against the fusing roller surface with a predetermined force. The thermistor end of the lower fusing roller temperature sensor 65 follows the slight upward and downward motion of the lower fusing roller 52 caused by the passage of printing media between the fusing rollers.

The fusing rollers 51, 52 are heated by respective internal heaters 66, 67. Both fusing rollers 51, 52 have surfaces made of a resilient material such as rubber.

Figure 2:
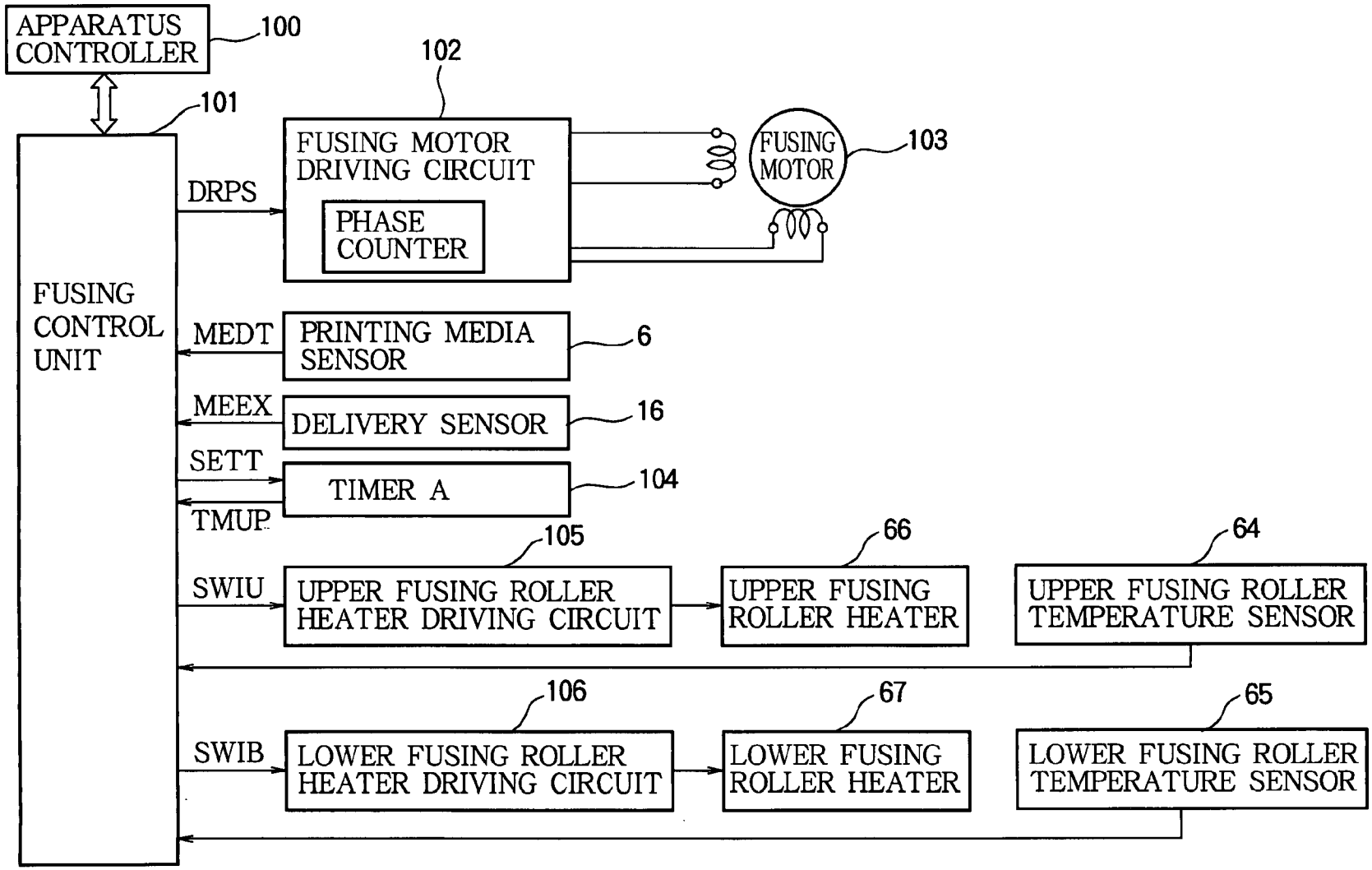
FIG. 2 is a block diagram of the electrical control system of the printer in FIG. 1 according to a first embodiment of the invention.

Referring to FIG. 2, the control system of the image forming apparatus 1 includes an apparatus controller 100 that manages and controls the entire image forming process. A separate fusing control unit 101, connected to the apparatus controller 100 by a serial communication interface, controls the operations related to fusing. The fusing control unit 101 includes a computing device such as a microprocessor with functions for executing commands received from the apparatus controller 100, returning data to the apparatus controller 100, sequencing the fusing operations, and synchronizing these operations with other image forming operations.

In particular, the fusing control unit 101 is connected to a fusing motor driving circuit 102 that receives a drive pulse signal DRPS from the fusing control unit 101, increments an internal phase counter according to the received pulses, and switches the excitation phase of a fusing motor 103 according to the phase count, thereby rotationally driving the fusing motor 103, which is a stepping motor.

The fusing control unit 101 is also connected to the printing media sensor 6, from which it receives the media detection signal MEDT; the delivery sensor 16, from which it receives the media exit signal MEEX; the fusing roller temperature sensors 64, 65, from which it receives roller surface temperature information; and a timer A 104 to which the fusing control unit 101 supplies a set-time signal SETT to set a timer value and from which it receives a time-up signal TMUP when the set time has elapsed. The roller surface temperature information is received from the temperature sensors 64, 65 in analog signal form; the fusing control unit 101 converts the analog signals to digital values.

An upper fusing roller heater driving circuit 105 receives an on/off switching signal SWIU from the fusing control unit 101 and drives the upper fusing roller heater 66, turning the upper fusing roller heater 66 on when the switching signal SWIU is at the high logic level (H) and off when the switching signal SWIU is at the low logic level (L), for example. A lower fusing roller heater driving circuit 106 receives a switching signal SWIB from the fusing control unit 101 and similarly drives the lower fusing roller heater 67. The fusing control unit 101 outputs the switching signals SWIU and SWIB according to the fuser roller surface temperatures sensed by the fusing roller temperature sensors 64, 65 so as to bring the fusing rollers 51, 52 to desired target temperatures, as described below.

The operations of the image forming apparatus that are relevant to fusing temperature control will now be described with reference to FIGS. 1–5.

The fusing control unit 101 obtains the target temperatures tmu, tmb of the upper and lower fusing rollers 51, 52 from the apparatus controller 100, and performs constant-temperature control so as to bring the surface temperatures of the fusing rollers 51, 52 to the target temperatures. In constant-temperature control, at regular intervals of, for example, 0.1 second, the fusing control unit 101 determines the present surface temperatures tru, trb of the upper and lower fusing rollers 51, 52 from the temperature information sensed by the fusing roller temperature sensors 64, 65, calculates temperature error values indicating the differences between the surface temperatures and the corresponding target temperatures, calculates fuser roller temperature gradient values, and sets the switching signals SWIU and SWIB to the high or low logic level according to the results of these calculations. The switching signals SWIU and SWIB remain at the set levels until the next interval of, for example, 0.1 second.

The fuser roller temperature gradient values are the differences between the present surface temperature values and the surface temperatures a certain number of intervals before. To calculate these gradient values, the fusing control unit 101 stores the past temperature values detected over that number of intervals. The fusing control unit 101 uses a weighted sum of the temperature error and temperature gradient values to decide how to set the switching signals SWIU and SWIB. For example, switching signal SWIU is set to turn the upper fusing roller heater 66 on if the surface temperature tru of the upper fusing roller 51 is declining and is already lower than the target temperature tmu, or if the surface temperature tru of the upper fusing roller 51 is still somewhat above the target temperature tmu but is declining rapidly.

When the printing process begins, the apparatus controller 100 sends the fusing control unit 101 a printing start command. The fusing control unit 101 then monitors the media detection signal MEDT from the printing media sensor 6. When MEDT goes high, indicating that the sheet of printing paper 15 representing the first page of the printing job is about to enter the printing process unit 2, the fusing control unit 101 begins output of the driving pulse signal DRPS to the fusing motor driving circuit 102 to start turning the fusing motor 103, and detects the surface temperatures tru, trb of the upper and lower fusing rollers 51, 52 sensed by the upper and lower fusing roller temperature sensors 64, 65.

If the surface temperature tru of the upper fusing roller 51 is less than a preset preheating threshold tss, the fusing control unit 101 ceases constant-temperature control of this roller and executes a preheating process to raise the roller temperature. First, the fusing control unit 101 outputs a set-time signal SETT to set a timer value equivalent to a certain preheating time Tp in timer A 104, starts timer A 104, and sets switching signal SWIU to turn on the upper fusing roller heater 66. The fusing roller heater 66 remains in the on state until the fusing control unit 101 receives the time-up signal TMUP from timer A 104, indicating that the preheating time Tp has elapsed, at which point the fusing control unit 101 reverts to constant-temperature control.

The preheating threshold temperature tss may be higher than the target temperature tmu. The preheating time Tp may be a fixed value substantially equal, for example, to the time taken for the leading edge of the printing paper 15 to arrive at the fuser 9 after passing the printing media sensor 6. Alternatively, the preheating time Tp may be varied according to, for example, the type of printing media and the printing speed. When the apparatus controller 100 sends the fusing control unit 101 the printing start command, it may also send information on the basis of which the fusing control unit 101 can select an appropriate preheating time Tp.

If the surface temperature tru of the upper fusing roller 51 is greater the preheating threshold tss when the media detection signal MEDT goes high, the fusing control unit 101 does not execute the preheating process for the upper fusing roller 51, but continues constant-temperature control.

A similar preheating process is also executed for the lower fusing roller 52 if its surface temperature trb is less than the preheating threshold tss when the media detection signal MEDT goes high.

The fusing control unit 101 continues constant-temperature control while the first page is fed through the fusing unit 9. When the media exit signal MEEX indicates (by going low, for example) that the first printed page has left the fuser 9 and passed the delivery sensor 16, the fusing control unit 101 temporarily stops the rotation of the fusing motor 103. Then if further pages are printed in succession, each time a new page arrives at the printing media sensor 6, processing similar to the processing described above is repeated.

Figure 3:
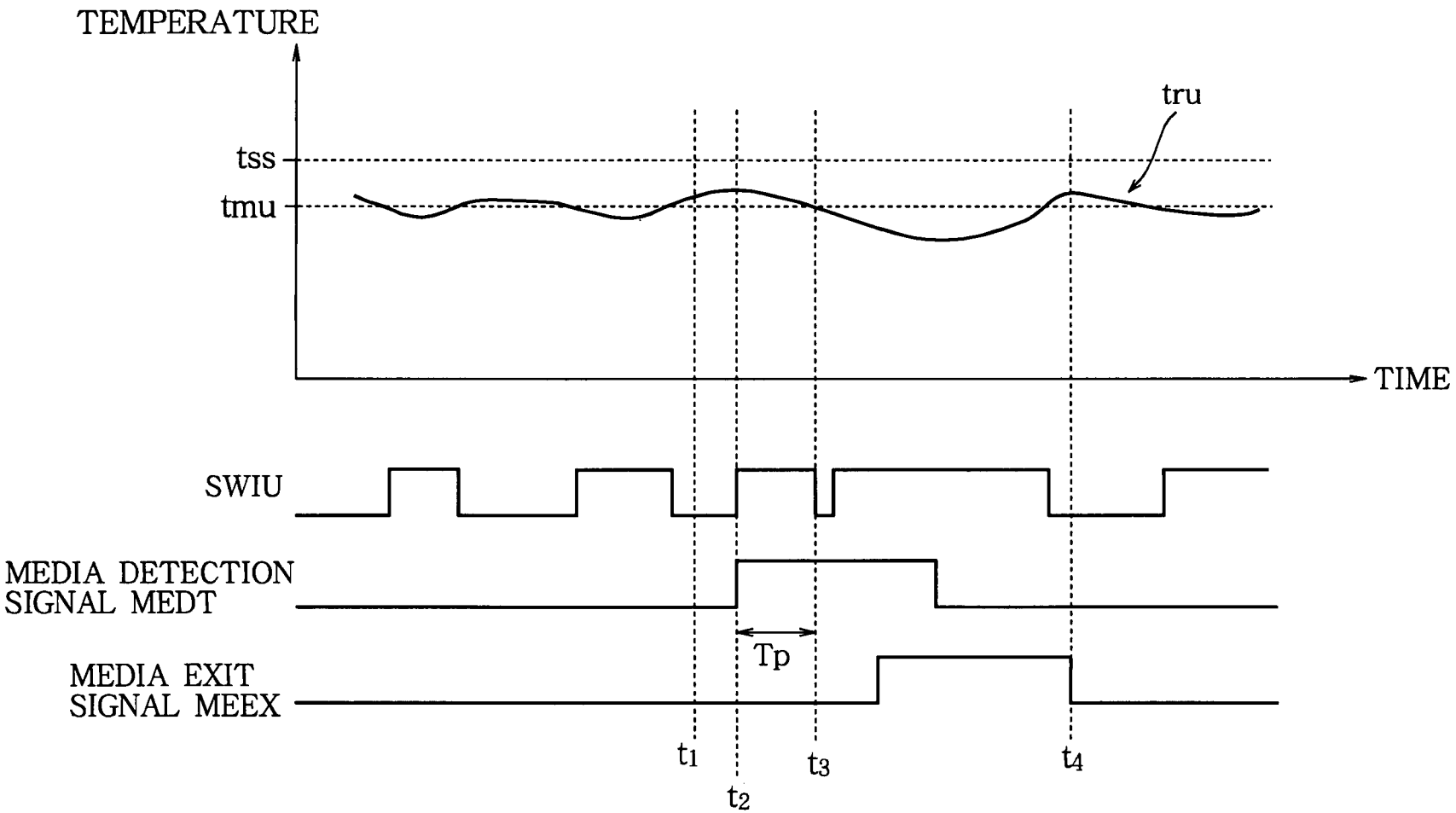
FIG. 3 is a timing diagram illustrating fusing temperature variations with preheating in the first embodiment.

FIG. 3 shows an example of the timing of the preheating process described above, taking the upper fusing roller as an example. Before time $t_1$, the fusing control unit 101 carries out constant-temperature control, using switching signal SWIU to turn the upper fuser roller heater 66 on and off to keep the surface temperature tru of the upper fusing roller 51 close to its target temperature tmu. At time $t_1$, the fusing control unit 101 receives a printing start command and begins driving the motor 103 that turns the upper fuser roller 51. When the leading edge of the printing paper 15 is recognized by the printing media sensor 6 at time $t_2$, the fusing control unit 101 compares the surface temperature tru of the upper fusing roller 51 with the preheating threshold tss. As the surface temperature tru is lower than the preheating threshold tss at this time, the fusing control unit 101 holds switching signal SWIU at the high logic level for a preheating interval of length Tp from time $t_2$ to time $t_3$, turning the upper fusing roller heater 66 on for this interval. After the elapse of the preheating time Tp, normal constant-temperature control resumes. Driving of the motor 103 that turns the upper fuser roller 51 stops when the trailing edge of the printing paper 15 passes the delivery sensor 16 and the media exit signal MEEX goes low at time $t_4$.

Figure 4:
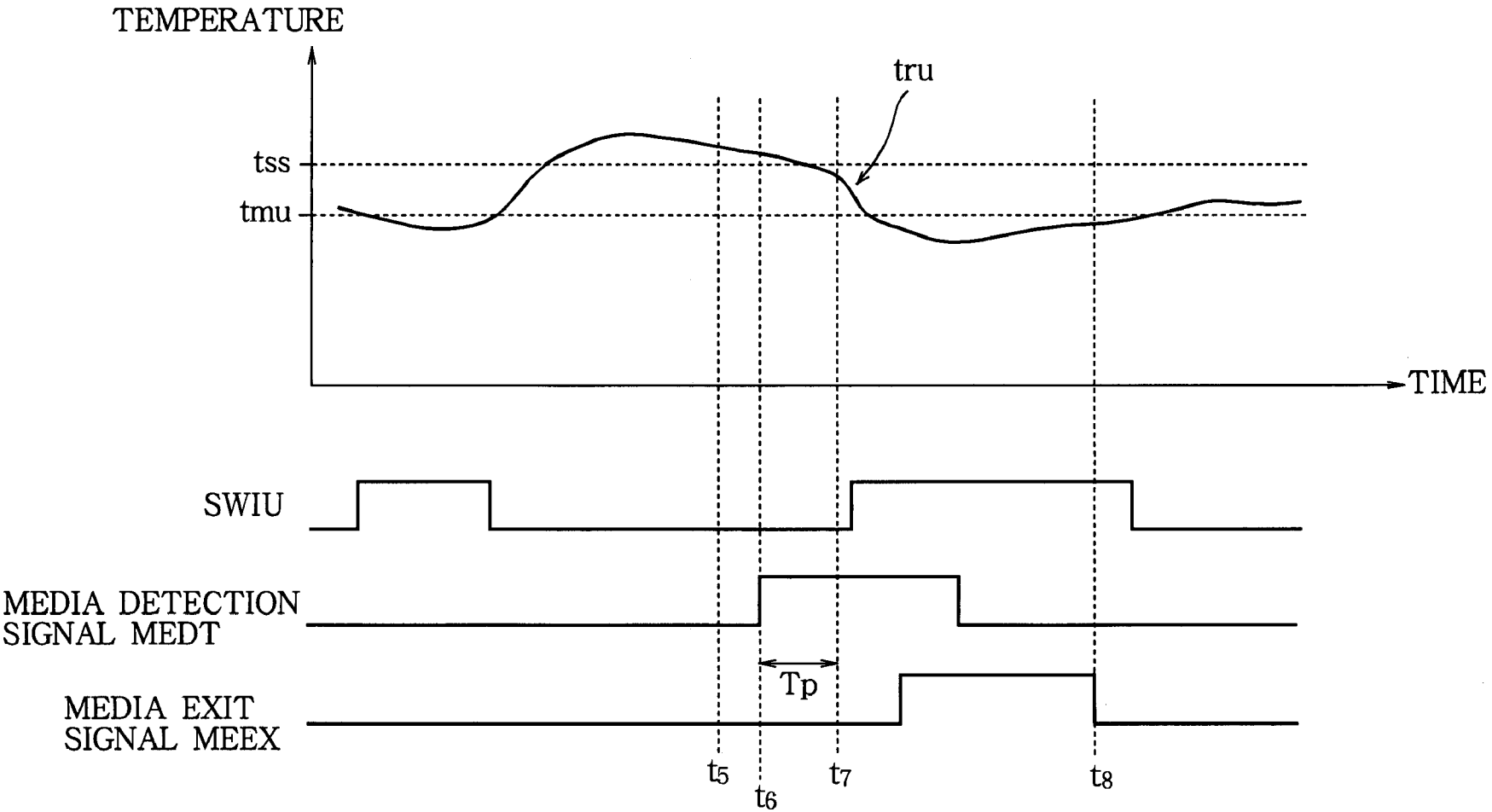
FIG. 4 is a graph illustrating fusing temperature variations without preheating in the first embodiment.

FIG. 4 shows a similar example in which the preheating process is not executed. Constant-temperature control is carried out as in FIG. 3, but for one reason or another, the surface temperature tru of the upper fusing roller 51 rises above the threshold value tss. The printing start command is received at time $t_5$ and the fusing rollers begin to turn. The temperature tru of the upper fusing roller 51 is still above the threshold tss when the leading edge of the printing paper 15 is recognized by the printing media sensor 6 at time $t_6$. The fusing control unit 101 accordingly does not execute the preheating process but continues normal constant-temperature control, allowing the roller temperature tru to return to a level near its target value tmu. In this example, the upper fusing roller heater 6 remains off during the interval of length Tp from time $t_6$ to time $t_7$, and is turned on slightly after time $t_7$, when the fusing control unit 101 recognizes the rapid drop in the surface temperature tru that occurs when the upper fusing roller 51 begins to lose heat to the printing paper 15. The fusing rollers stop turning when the media exit signal MEEX goes low at time $t_8$.

Temperature control of the lower fusing roller 52 is carried out by similar timing, but is independent of the temperature control of the upper fusing roller 51, assuring that each fusing roller stays at or near its target temperature during the fusing process.

In a variation of the first embodiment, the fuser 9 has a single fusing roller that turns in compliance with a heat-resistant belt. The heat-resistant belt transports the printing medium and presses it against the fusing roller, which has an internal heater. Alternatively, the belt may be heated. Constant-temperature control and preheating are carried out as described above.

Figure 5:
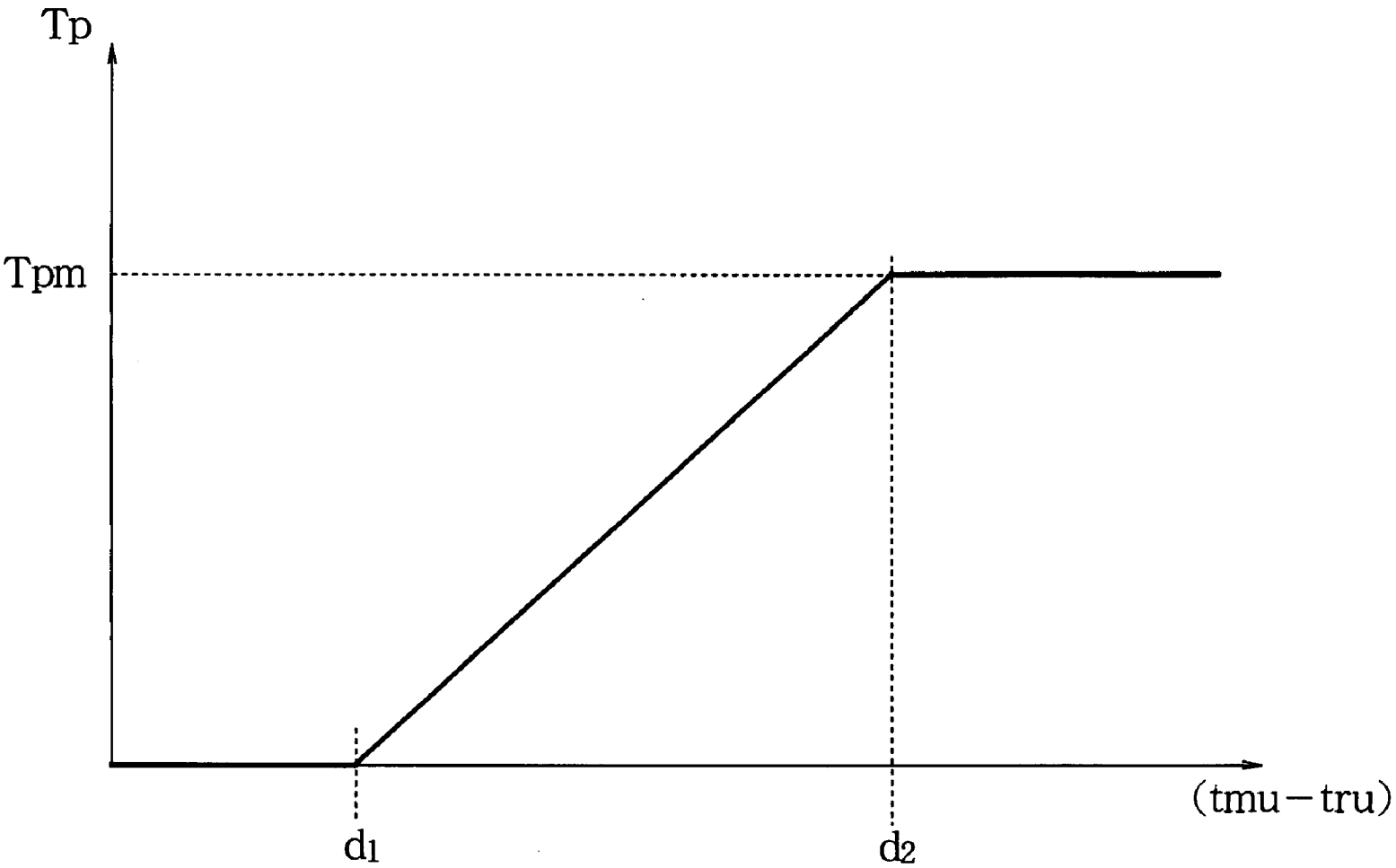
FIG. 5 is an exemplary graph illustrating the determination of the preheating time.

In another variation of the first embodiment, the preheating time Tp is varied according to the difference (tmu−tru) between the surface temperature tru and the target temperature tmu as illustrated in FIG. 5, for example. In this example, as the difference (tmu−tru) varies over an interval from a first difference $d_1$ to a second difference $d_2$ (where $d_2>d_1$), the preheating time Tp varies linearly from a minimum value of zero to a maximum value of Tpm. Preheating is not carried out if the difference (tmu−tru) is equal to or less than $d_1$, and the maximum preheating time Tpm is used if the difference (tmu−tru) is equal to or greater than $d_2$. This scheme enables the fusing rollers to receive adequate preheating without being overheated. The preheating time Tp can also be varied according to a weighted sum of the type used in constant-temperature control, taking both the temperature difference and its rate of change or gradient into consideration.

By preheating the fusing rollers before fusing begins, the first embodiment enables the fuser rollers to store enough internal heat near their surfaces to reduce the surface temperature drop that occurs when printing media come into contact with the fusing rollers, despite the thermal resistance and heat capacity of the fusing rollers. When a plurality of pages are printed in succession, the preheating operation before the second and subsequent pages can be skipped if the roller surface temperature remains high, avoiding the supply of excessive heat to the fusing rollers that could occur if preheating were to be carried out unconditionally.

Second Embodiment

Figure 6:
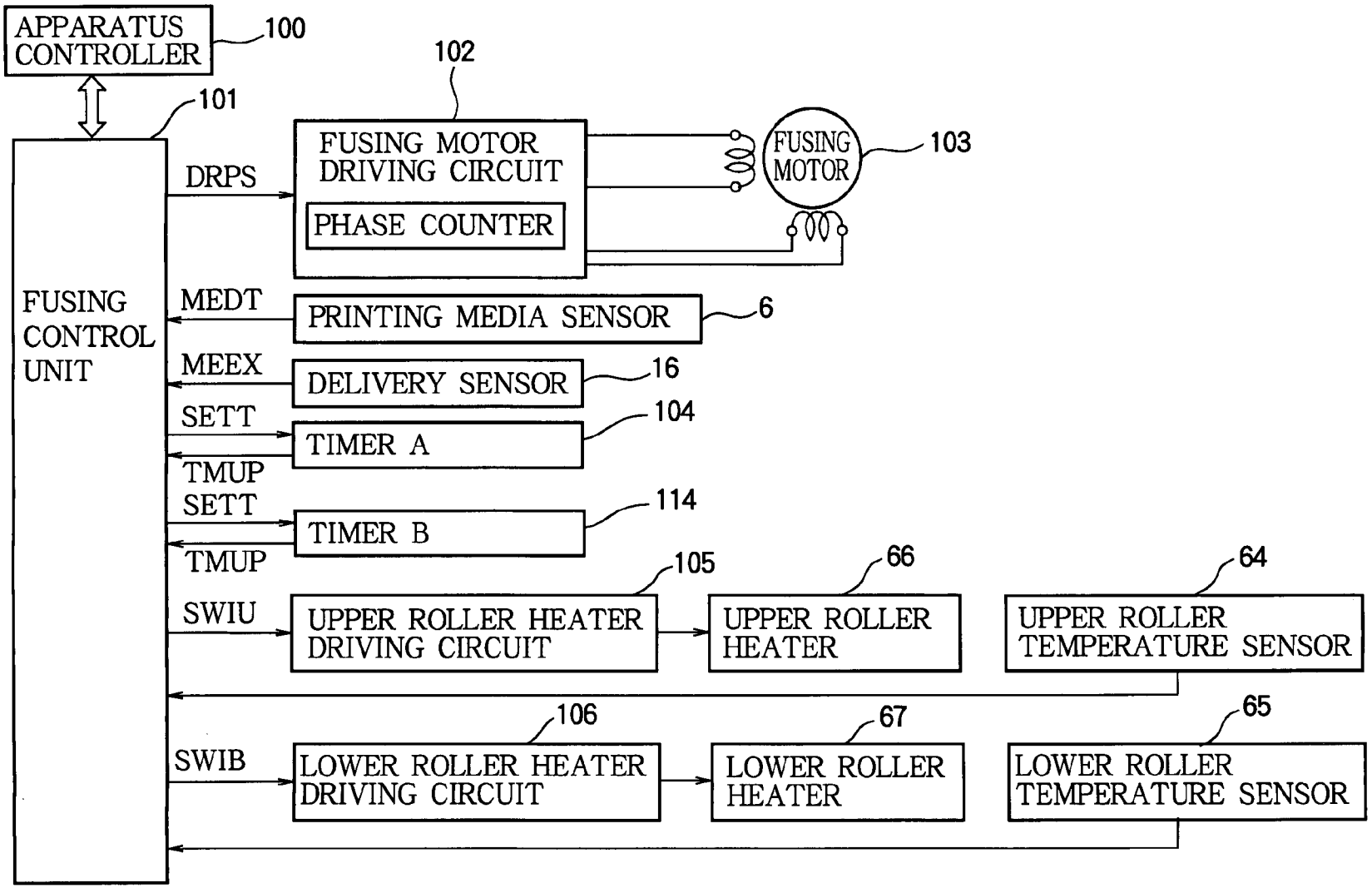
FIG. 6 is a block diagram of the electrical control system of the printer in FIG. 1 according to a second embodiment of the invention.

The second embodiment is a color printer having the mechanical configuration shown in FIG. 1 and the control system shown in FIG. 6. The second embodiment differs from the first embodiment in the addition of a second timer B 114 to the control system. The fusing control unit 101 in FIG. 6 uses timer B to decide whether or not to execute the preheating process, instead of making this decision by comparing the fusing roller surface temperatures with a threshold temperature as in the first embodiment.

Like timer A 104, timer B 114 receives a set-time signal SETT from the fusing control unit 101, measures a corresponding interval of time, and returns a time-up signal TMUP to the fusing control unit 101 at the end of the interval. The fusing control unit 101 uses timer B to measure a post-fusing interval Td starting from the time at which the delivery sensor 16 recognizes the trailing edge of the printing paper 15. The fusing control unit 101 executes the preheating process if the printing media sensor 6 does not detect the next sheet of printing paper (or other printing media) within the post-fusing interval Td. If the printing media sensor 6 detects the next sheet of printing paper within the post-fusing interval Td, the preheating process is omitted.

The description of the operation of the control system in FIG. 6 will be preceded by an explanation of how the internal and surface temperatures of the upper and lower fusing rollers 51, 52 of the fuser 9 vary under different conditions. Table 1 summarizes these variations.

TABLE 1

| | Roller Temp. before fusing | | Roller Temp. after preheating | | Roller Temp. just after fusing starts | | Condition at |
|---|---|---|---|---|---|---|---|
| | Internal | Surface | Internal | Surface | Internal | Surface | start of fusing |
| 1)After standby without preheating | OK | OK | — | — | OK | Cold | Cold offset |
| 2)After standby with preheating | OK | OK | Hot | OK | Hot | OK | OK |
| 3)After continuous printing without preheating | Hot | OK | — | — | Hot | OK | OK |
| 4)After continuous printing with preheating | Hot | OK | Very hot | Hot | Hot | Hot | Hot offset |

In case 1) in Table 1, fusing begins after the fusing rollers 51, 52 have been left in the standby state and the preheating process has not been performed. In the standby state, the rotation of the fusing rollers 51, 52 is halted but constant-temperature control is continued. The standby state in case 1) has continued long enough for both the internal temperatures and the surface temperatures tru, trb of the fusing rollers 51, 52 to settle into a steady state at appropriate levels (OK) near the target temperatures tmu, tmb. When fusing starts, however, the surface temperatures of the fusing rollers 51, 52 abruptly drop as heat is lost to the printing paper 15, causing a cold offset. The cold offset occurs because the poor thermal conductivity of the rubber surface material of the fusing rollers prevents heat from being rapidly replenished from the interiors of the fusing rollers to compensate for the heat lost from the surfaces.

In case 2) in Table 1, fusing begins after a standby interval followed by preheating. The preheating process raises the internal temperature of the fusing rollers from the appropriate surface level (OK) to a somewhat higher level (hot), so heat begins to flow from the interiors of the fusing rollers toward their surfaces. When fusing starts, this heat reaches the surfaces of the rollers, offsetting the loss of heat to the printing media. The surface temperatures of the fusing rollers accordingly remain at the appropriate level (OK).

In case 3) in Table 1, pages are printed in succession, and the fusing of each page begins without a preceding standby interval, or with only a brief standby interval. Even though no preheating process is executed, the internal temperatures of the fusing rollers 51, 52 are still hot when fusing begins. The reason is that due to constant-temperature control during continuous printing, heat is continually flowing from the interiors of the fusing rollers 51, 52 to the surfaces of the fusing rollers to replace the heat lost to the printing media, so the control process must keep the interiors of the fusing rollers hotter than their surfaces. Even though the heaters 66, 67 may be turned off during the brief interval between the fusing of one page and the next, during this interval little heat is lost from the surfaces of the fusing rollers 51, 52, so the flow of heat from their interiors is slowed and the interiors of the fusing rollers retain enough heat to compensate for the surface temperature drop at the start of the fusing of the next page. The surface temperatures of the fusing rollers 51, 52 therefore remain at suitable levels as in case 2).

In case 4) in Table 1, pages are printed in continuous succession but the preheating process is executed unconditionally. As a result of the preheating process the internal temperatures of the fusing rollers 51, 52, which were higher than the target temperatures to begin with, become even higher, and the surface temperatures of the fusing rollers also rise above the appropriate levels. A hot offset therefore occurs.

Both the cold offset in case 1) and the hot offset in case 4) in Table 1 should be avoided. For consistent fusing, the preheating process should be executed if the standby state has continued for a comparatively long time, but should not be executed if the standby state lasts for only a short time, or for zero time as during continuous printing.

The operation of the second embodiment will now be described with reference to FIG. 7, taking the temperature control of the upper fusing roller 51 as an example.

Figure 7:
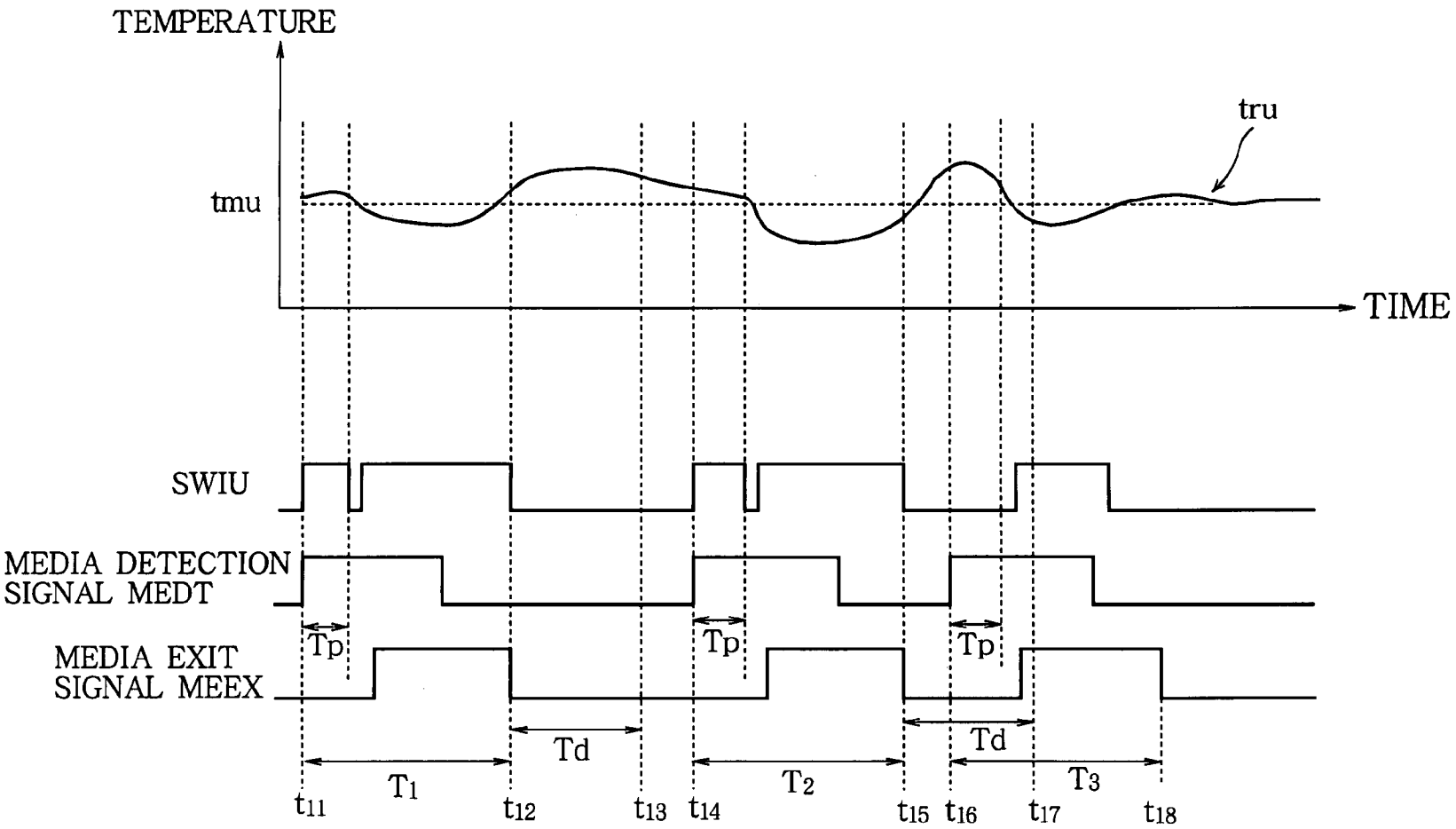
FIG. 7 is a timing diagram illustrating fusing temperature variations with preheating in the second embodiment.

In FIG. 7, following an initial standby interval, a single page is printed during a first printing cycle $T_1$; then after an intervening period, two pages are printed successively during printing cycles $T_2$ and $T_3$. Printing cycles $T_1$ and $T_2$ are separated by a time longer than the post-fusing interval Td; printing cycles $T_2$ and $T_3$ are separated by a time shorter than the post-fusing interval Td. The fusing rollers 51, 52 are driven rotationally during the three printing cycles $T_1$, $T_2$, $T_3$.

During the initial standby interval (not shown), the fusing control unit 101 carries out constant-temperature control, bringing both the surface temperature tru of the upper fusing roller 51 and its internal temperature, which is not observable, close to the target temperature tmu. When the media detection signal MEDT input from the printing media sensor 6 goes high at time $t_{11}$ to indicate that the first page is about to enter the printing process unit 2, the fusing control unit 101 sets switching signal SWIU to the high level for the preheating time Tp, as measured by timer A 104, to execute the preheating process. When the media delivery signal MEEX goes low at time $t_{12}$, indicating that the trailing edge of the first page has passed the delivery sensor 16, the fusing control unit 101 sends timer B 114 a set-time signal SETT, thereby writing a value equivalent to the post-fusing interval Td in timer B 114.

The post-fusing interval Td times out at time $t_{13}$, before the next page is detected, and timer B 114 returns a time-up signal TMUP to the fusing control unit 101. During the post-fusing interval Td, the internal temperature of the upper fusing roller 51, which was somewhat high during the printing cycle $T_1$, returns to the standby level. When the media detection signal MEDT goes high at time $t_{14}$ to indicate that the leading edge of the next page has passed the printing media sensor 6, since the fusing control unit 101 has already received a time-up signal from timer B, it sets switching signal SWIU to the high level to turn on the fusing roller heater 66 in the upper fusing roller 51 for the preheating time Tp and execute the preheating process again.

When the second page printing cycle $T_2$ ends at time $t_{15}$, the fusing control unit 101 sends another set-time signal SETT to timer B 114 to begin counting the next post-fusing interval Td. At time $t_{16}$, before the post-fusing interval Td ends, the media detection signal MEDT goes high, indicating that the printing media sensor 6 has detected the next page. The internal temperature of the upper fusing roller 51 is still somewhat high at this time, as is the surface temperature tru. Since the fusing control unit 101 has not received a time-up signal yet, it does not execute the preheating process at the start of the printing cycle $T_3$ of the next page, which begins with detection of the printing paper 15 at time $t_{16}$. The fusing control unit 101 turns the upper fusing roller heater 66 on when the surface temperature tru of the upper fusing roller falls below the target value tmu, ignores the time-up signal at time $t_{17}$, and leaves the heater 66 on until the end of the printing cycle at time $t_{18}$.

In printing cycles $T_1$ and $T_2$, when the fusing control unit 101 executes the preheating process because the printing operation for the next page starts after the elapse of the post-fusing interval Td, the preheating process raises the internal temperature of the fusing roller as in case 2) in Table 1, so that the surface temperature remains normal even after fusing begins. In printing cycle $T_3$, although the fusing control unit 101 does not execute the preheating process because the printing operation for printing the next page starts during the post-fusing interval Td, the internal temperature of the fusing roller is still hotter than normal, as in case 3) in Table 1, so once again the surface temperature of the fusing roller remains normal after fusing begins.

Similar temperature control is also carried out for the lower fusing roller 52.

Figure 8:
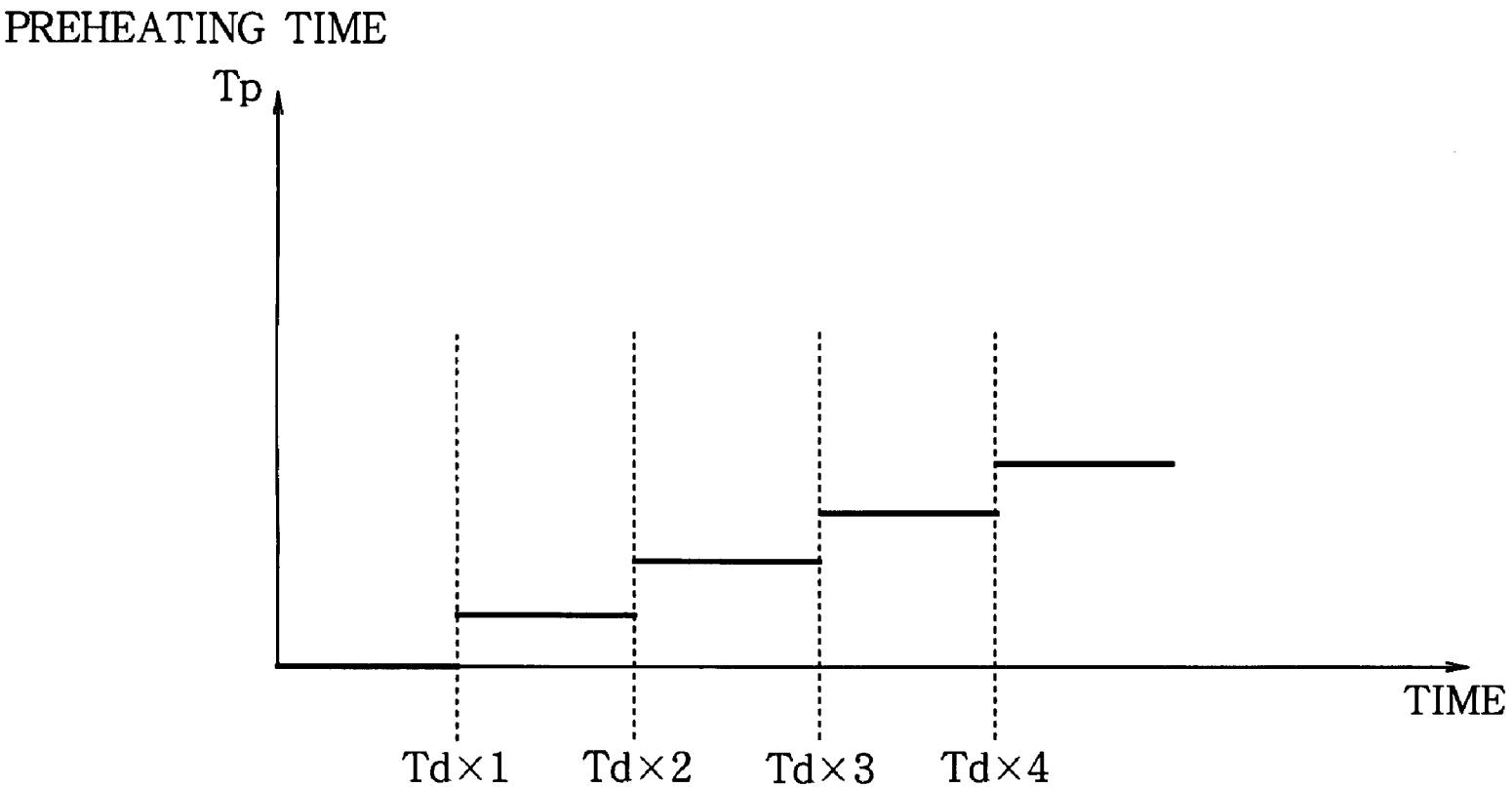
FIG. 8 is an exemplary graph illustrating the dependence of the preheating time on the standby time.

In a variation of the second embodiment, the length of the preheating interval Tp is varied according to the length of the standby time from the end of one printing cycle to the start of the next printing cycle. For example, the fusing control unit 101 may use timer B to count the elapse of a post-fusing interval Td repeatedly until the printing of the next page begins. The preheating time Tp may then be varied according to the number of times the count is repeated so that the preheating time Tp increases stepwise with the length of the standby time, as shown in FIG. 8. The preheating time thus becomes responsive to the presumed degree of internal cooling of the fuser rollers and cooling of the roller heaters during the lapse of time after the end of printing.

In another variation of the second embodiment, the fusing control unit 101 receives information from the apparatus controller 100 indicating when pages will be printed continuously, and omits the preheating process on the basis of that information.

Like the first embodiment, the second embodiment avoids the temperature drop at the start of fusing due to the heat transfer delay in the fusing rollers. In addition, the second embodiment infers the internal temperature of the fusing rollers from the length of the standby interval between pages, and avoids unnecessary preheating when the fusing rollers are still internally hot, even though their surface temperature may be lower than normal because of heat absorption by the printing media, thereby avoiding the occurrence of hot offset.

Third Embodiment

Figure 9:
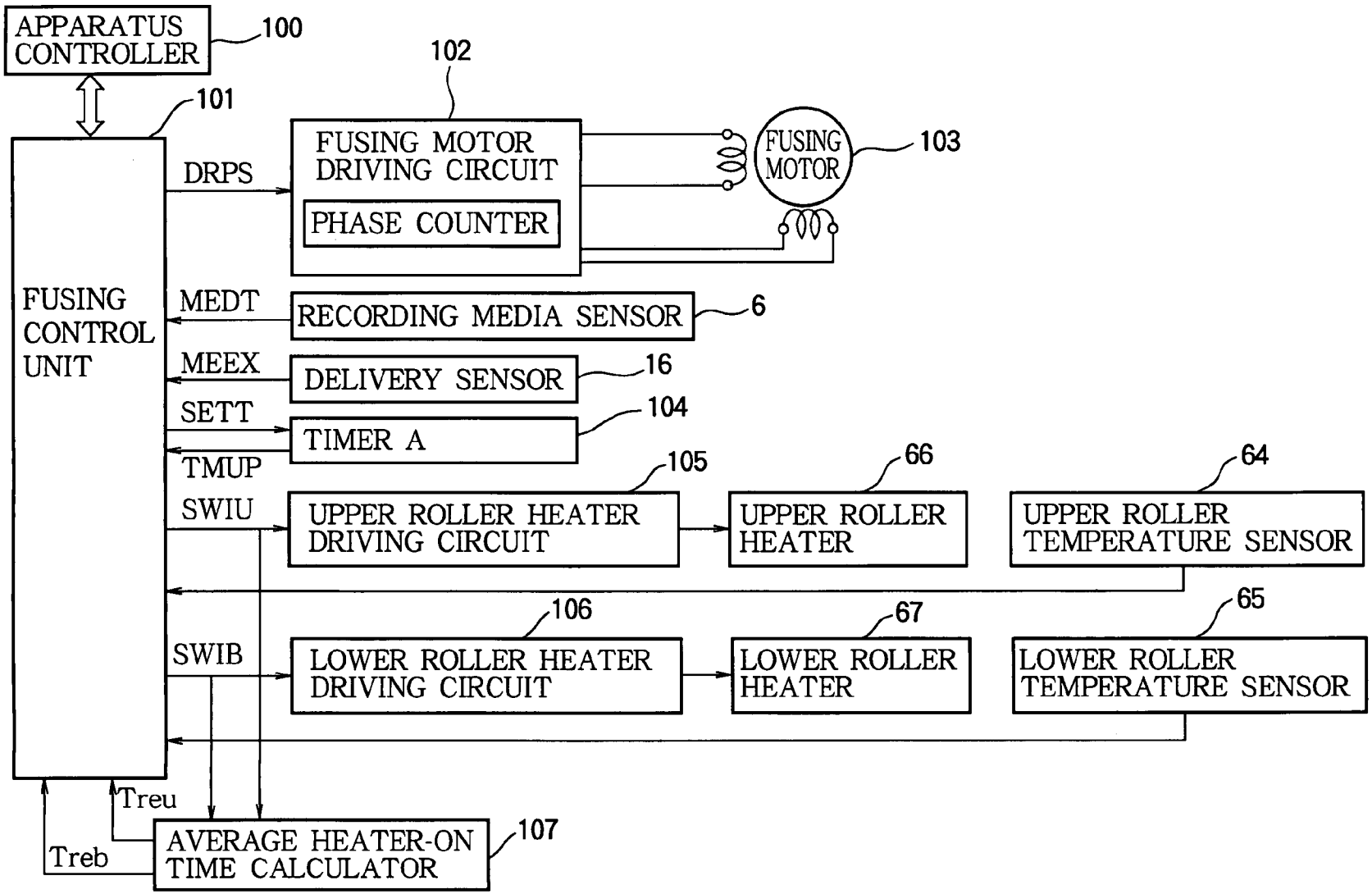
FIG. 9 is a block diagram of the electrical control system of the printer in FIG. 1 according to a third embodiment of the invention.

The third embodiment is a color printer having the mechanical configuration shown in FIG. 1 and the control system shown in FIG. 9. The third embodiment differs from the first embodiment in the addition of an average heater-on time calculator 107 to the control system. The fusing control unit 101 in FIG. 9 uses the average heater-on time calculator 107 to decide whether or not to execute the preheating process, instead of making this decision by comparing the fusing roller surface temperatures with a temperature threshold.

The average heater-on time calculator 107 receives the switching signals SWIU and SWIB output from the fusing control unit 101 to the roller heater driving circuits. At regular averaging intervals, the average heater-on time calculator 107 calculates the average percentage of time during which each of the roller heaters has been turned on during the preceding averaging interval. The calculated average heater-on times of the upper and lower fusing roller heaters will be denoted Tavu and Tavb, respectively. An average on-time of 100% indicates that the fusing roller heater 66 or 67 has been on continuously during the most recent averaging interval; an average on-time of 0% indicates that the fusing roller heater has been off continuously during that interval.

Figure 10:
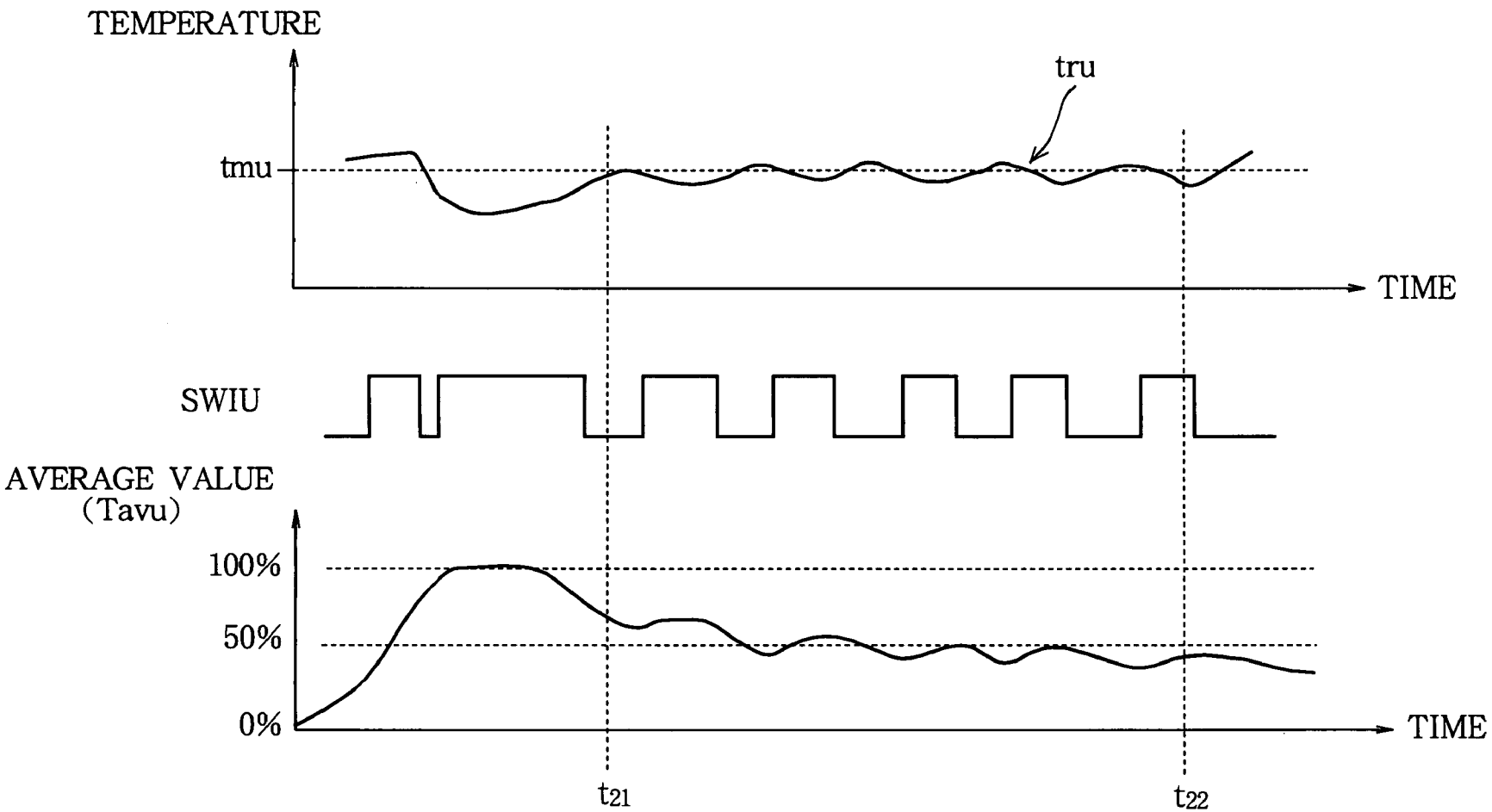
FIG. 10 is a timing diagram illustrating fusing temperature variations with preheating in the third embodiment.

FIG. 10 shows a conceptual example of the changes over time of the surface temperature tru of the upper fusing roller 51 and its average heater-on time Tavu when a plurality of pages are printed continuously under constant-temperature control, without preheating. Constant-temperature control is carried out by the same method for both the upper and lower fusing rollers 51, 52, so the same concept applies to the lower fusing roller 52.

At the first stage of continuous printing, because of the large drop in the fusing roller surface temperature due to the internal heat transfer delay in the fusing roller, the surface temperature tru falls below the target value tmu. The heater is therefore turned on continuously for an extended time, and the average heater-on time Tavu takes on a value near 100%.

Thereafter, as printing continues and the surface temperature tru gradually converges on the target temperature tmu, the average heater-on time Tavu also converges on a constant value. This value is the value at which the amount of heat generated by the heater is equal to the amount of heat lost to the printing paper 15, and is about 50% in the present embodiment.

If continuous printing ends at time $t_{22}$, when the amount of heat generated by the heater 66 in the upper fusing roller 51 is approximately equal to the amount of heat lost to the printing paper 15, it will be necessary to execute the preheating process to prevent a temperature drop due to heat transfer delay when printing resumes, even if this occurs only shortly afterward. If continuous printing were to end at time $t_{21}$, however, when the amount of heat generated in the upper fusing roller 51 was greater than the amount of heat being lost to the printing paper 15, the preheating process should not be executed if printing resumes shortly thereafter, because there is still enough heat in the interior of fusing roller to raise the surface temperature in preparation for the temperature drop, and preheating would cause the fusing roller to overheat.

The operation of the control system in the third embodiment will now be described on the basis of the flowchart in FIG. 11. For simplicity, this flowchart illustrates only the preheating control of the upper fusing roller 51, omitting the preheating control of the lower fusing roller 52 and the constant-temperature control process that the fusing control unit 101 executes when it is not executing the preheating process.

Figure 11:
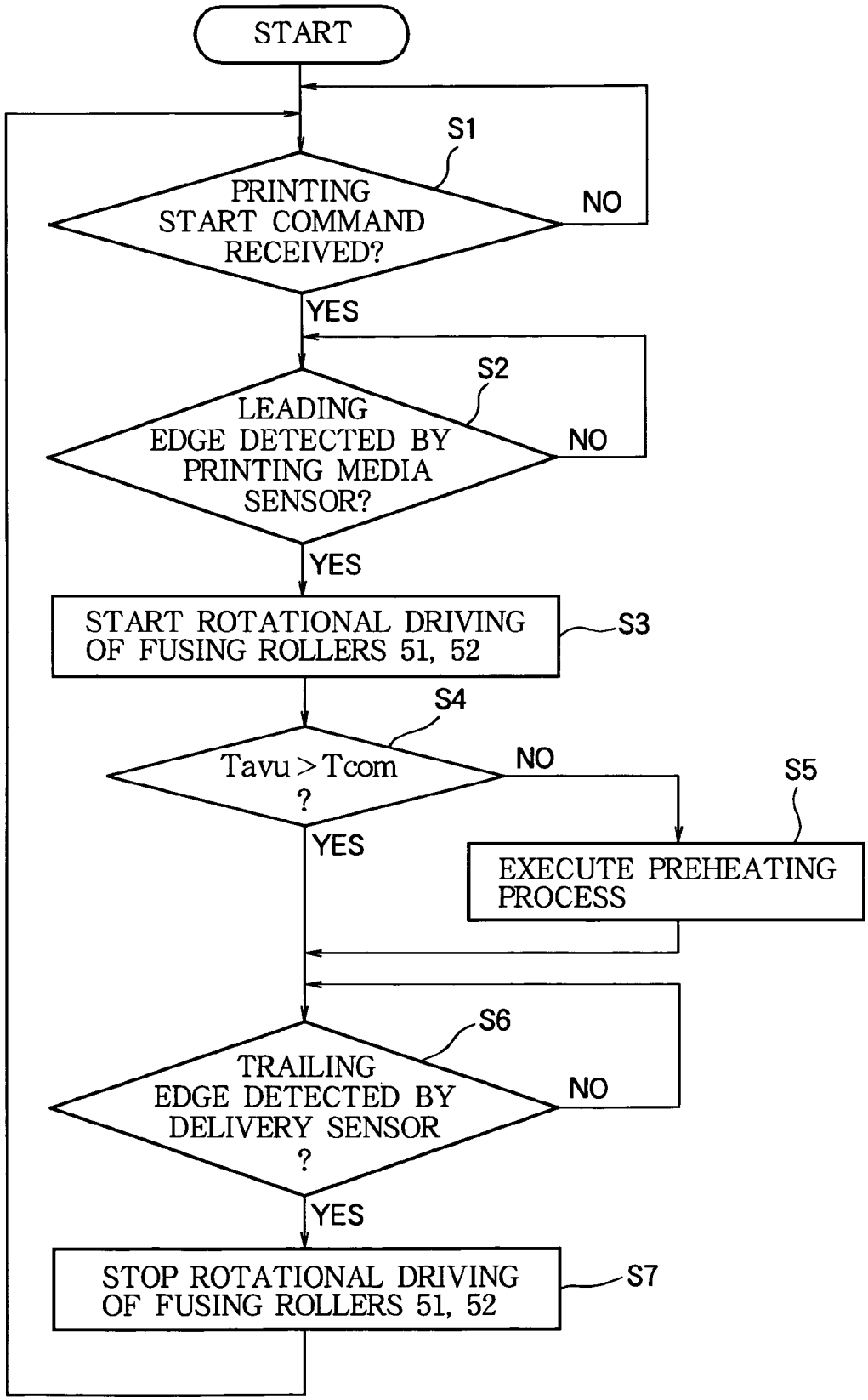
FIG. 11 is a flowchart illustrating the preheating process in the third embodiment.

At the beginning of the operation flow in FIG. 11, the fusing control unit 101 is waiting for the arrival of a printing start command from the apparatus controller 100 (step S1). After receiving this command, the fusing control unit 101 waits for the MEDT signal from the printing media sensor 6 to indicate that the printing paper 15 is about to enter the printing process unit 2 (step S2). When the printing paper 15 is detected by the printing media sensor 6, the fusing control unit 101 starts supplying drive pulses that rotationally drive the fusing rollers 51, 52 at a predetermined speed (step S3), and decides whether or not the average heater-on time Tavu is currently greater than a heater-on time threshold Tcom such as, for example, 50% (step S4).

If the average heater-on time Tavu is less than the heater-on time threshold Tcom, the fusing control unit 101 sets switching signal SWIU to the high logic level for the preheating interval Tp, turning on the upper fusing roller heater 66 for this interval and executing the preheating process (step S5). Conversely, if the average heater-on time Tavu is equal to or greater than the heater-on time threshold Tcom, processing proceeds to the next step without execution of the preheating process.

Next, the fusing control unit 101 waits for the media exit MEEX signal that indicates that the fused printing paper 15 has emerged from the fuser 9 and passed the delivery sensor 16 (step S6). When this signal is received, the fusing control unit 101 stops rotationally driving the fusing rollers 51, 52 (step S7), and returns to step S1 to await the arrival of another printing start command from the apparatus controller 100, after which the same processing is repeated.

The third embodiment avoids excessive heating by deciding whether or not to execute the preheating process according to an estimate of the heater temperature and the temperature of the interior of the roller.

In a variation of the third embodiment, the preheating time Tp is varied according to the difference (Tcom−Tavu) between the average heater-on time Tavu and the heater-on time threshold Tcom. A scheme similar to the one illustrated in FIG. 5 can be employed, for example.

The third embodiment provides a way to compensate for the internal heat transfer delay of the fusing rollers without the risk of overheating when the difference between the surface temperature and the internal temperature of the fusing rollers is large, as it may be immediately after the printing of a succession of pages ends, for example. Furthermore, since differences in heat absorption due to differences in the thickness of printing media and differences in the rate of heat absorption per unit time due to differences in printing speed appear as differences in the average heater-on time, the preheating process is also responsive to the type of printing media and type of printing, enabling the roller temperature to be kept consistently near the target temperature even under conditions of fluctuating thermal load.

The three different ways of deciding whether or not to execute the preheating process illustrated in the preceding embodiments can be combined. For example, it is possible to decide whether or not to execute preheating by carrying out all three decision processes, weighting the individual decision results, and comparing the weighted sum with a decision threshold.

The invention can also be practiced in an image forming apparatus having a fuser of the belt type instead of a fuser of the roller type.

Those skilled in the art will recognize that further variations are possible within the scope of invention, which is defined by the appended claims.

What is claimed is:

1. An image forming apparatus having an image forming unit for forming a toner image on a printing medium as the printing medium is transported through the image forming unit and a fuser for applying heat to the printing medium to fuse the toner image onto the printing medium after the printing medium leaves the image forming unit, the image forming apparatus comprising:

a heater for heating the fuser;

a temperature sensor for sensing a temperature of the fuser; and a control unit for controlling the heater according to the temperature sensed by the temperature sensor to hold the fuser at a predetermined target temperature while the toner image is being fused onto the printing medium, and for preheating the fuser, responsive to a condition of the fuser, before the fuser applies heat to the printing medium;

wherein the control unit compares the sensed temperature of the fuser with a threshold temperature higher than the target temperature, and causes the heater to preheat the fuser while the sensed temperature is less than the threshold temperature.

2. An image forming apparatus having an image forming unit for forming a toner image on a printing medium as the printing medium is transported through the image forming unit and a fuser for applying heat to the printing medium to fuse the toner image onto the printing medium after the printing medium leaves the image forming unit, the image forming apparatus comprising:

a heater for heating the fuser;

a temperature sensor for sensing a temperature of the fuser; and a control unit for controlling the heater according to the temperature sensed by the temperature sensor to hold the fuser at a predetermined target temperature while the toner image is being fused onto the printing medium, and for preheating the fuser, responsive to a condition of the fuser, before the fuser applies heat to the printing medium;

wherein the control unit compares the sensed temperature of the fuser with a threshold temperature, and has the heater preheat the fuser if the sensed temperature is less than the threshold temperature; and further comprising a media sensor for sensing the printing medium as the printing medium enters the image forming unit, wherein the temperature of the fuser compared with the threshold temperature is the temperature sensed as the printing medium enters the image forming unit.

3. The image forming apparatus of claim 2, wherein the control unit has the heater preheat the fuser by supplying different amounts of heat depending on the sensed temperature of the fuser.

4. The image forming apparatus of claim 3, wherein the control unit has the heater supply different amounts of heat by preheating the fuser for different lengths of time.

5. The image forming apparatus of claim 4, wherein the control unit calculates a difference between the sensed temperature of the fuser and the predetermined target temperature, omits preheating of the fuser if the difference is less than a first value, has the heater preheat the fuser for a maximum length of time if the difference is greater than a second value, and has the heater preheat the fuser for increasing lengths of time as the difference increases from the first value to the second value.

6. An image forming apparatus having an image forming unit for forming a toner image on a printing medium as the printing medium is transported through the image forming unit and a fuser for applying heat to the printing medium to fuse the toner image onto the printing medium after the printing medium leaves the image forming unit, the image forming apparatus comprising:

a heater for heating the fuser;

a temperature sensor for sensing a temperature of the fuser; and a control unit for controlling the heater according to the temperature sensed by the temperature sensor to hold the fuser at a predetermined target temperature while the toner image is being fused onto the printing medium, and for preheating the fuser, responsive to a condition of the fuser, before the fuser applies heat to the printing medium;

wherein the control unit has the heater preheat the fuser if a time interval between transport of different sheets of the printing medium exceeds a threshold time.

7. The image forming apparatus of claim 6, further comprising a first sensor for sensing the printing medium as the printing medium enters the image forming unit and a second sensor for sensing the printing medium as the printing medium leaves the fuser, wherein the time interval is an interval from when one sheet of the printing medium leaves the fuser to when another sheet of the printing medium enters the image forming unit, as sensed by the first sensor and the second sensor.

8. The image forming apparatus of claim 6, wherein the control unit has the heater preheat the fuser by supplying different amounts of heat depending on the time interval between the transport of said different sheets of the printing medium.

9. The image forming apparatus of claim 8, wherein the control unit has the heater supply different amounts of heat by preheating the fuser for different lengths of time.

10. The image forming apparatus of claim 9, wherein the control unit has the heater preheat the fuser for stepwise increasing lengths of time as the time interval between the transport of said different sheets of the printing medium increases.

11. An image forming apparatus having an image forming unit for forming a toner image on a printing medium as the Printing medium is transported through the image forming unit and a fuser for applying heat to the printing medium to fuse the toner image onto the printing medium after the printing medium leaves the image forming unit, the image forming apparatus comprising:

a heater for heating the fuser;

a temperature sensor for sensing a temperature of the fuser; and a control unit for controlling the heater according to the temperature sensed by the temperature sensor to hold the fuser at a predetermined target temperature while the toner image is being fused onto the printing medium, and for preheating the fuser, responsive to a condition of the fuser, before the fuser applies heat to the printing medium;

wherein the control unit determines an amount of heat generated by the heater over a preceding interval of time and has the heater preheat the fuser if the amount of heat generated is less than a threshold amount.

12. The image forming apparatus of claim 11, further comprising a media sensor for sensing the printing medium as the printing medium enters the image forming unit, wherein the preceding interval is an interval preceding entry of the printing medium to the image forming unit as sensed by the media sensor.

13. The image forming apparatus of claim 11, wherein the control unit controls the heater by switching the heater on and off, and determines the amount of heat generated by determining a proportion of time during which the heater is switched on.

14. The image forming apparatus of claim 11, wherein the control unit has the heater preheat the fuser for different lengths of time depending on the amount of heat generated during the preceding interval of time.

15. The image forming apparatus of claim 1, wherein the fuser comprises a rotating body.

16. The image forming apparatus of claim 1, wherein the fuser comprises a fusing roller.

17. The image forming apparatus of claim 16, wherein the heater is disposed inside the fusing roller.

18. The image forming apparatus of claim 17, wherein the sensed temperature of the fuser is a surface temperature of the fusing roller.

19. The image forming apparatus of claim 1, wherein the fuser comprises a pair of fusing rollers with resilient surfaces, the fusing rollers being urged into mutual contact, the printing medium being transported between the fusing rollers.

20. An image forming apparatus having an image forming unit for forming a toner image on a printing medium as the printing medium is transported through the image forming unit and a fuser for applying heat to the printing medium to fuse the toner image onto the printing medium after the printing medium leaves the image forming unit, the image forming apparatus comprising:

a heater for heating the fuser;

a temperature sensor for sensing a temperature of the fuser; and a control unit for controlling the heater according to the temperature sensed by the temperature sensor to hold the fuser at a predetermined target temperature while the toner image is being fused onto the printing medium, and for preheating the fuser, responsive to a condition of the fuser, before the fuser applies heat to the printing medium;

wherein the fuser comprises a pair of fusing rollers with resilient surfaces, the fusing rollers being urged into mutual contact, the printing medium being transported between the fusing rollers; and wherein:

each of the fusing rollers has a separate surface temperature sensor;

each of the fusing rollers has a separate internal heater controlled by the control unit; and the control unit controls the preheating of each fusing roller separately.

21. The image forming apparatus of claim 1, wherein the control unit has the heater preheat the fuser by supplying different amounts of heat depending on the sensed temperature of the fuser.

22. The image forming apparatus of claim 2, wherein the fuser comprises a rotating body.

23. The image forming apparatus of claim 6, wherein the fuser comprises a rotating body.

24. The image forming apparatus of claim 11, wherein the fuser comprises a rotating body.

* * * * *